US005823322A

United States Patent [19]

Johnson

[11] Patent Number: 5,823,322

[45] Date of Patent: Oct. 20, 1998

[54] SNAPIN INSTANTLY WIRED ONE PIECE THERMO PLASTIC LAMP SOCKET

[76] Inventor: Bates Johnson, 8 Russet La., Essex, Conn. 06426

[21] Appl. No.: 818,305

[22] Filed: Mar. 14, 1997

Related U.S. Application Data

[60] Provisional application No. 60/013,640 Mar. 18, 1996.

[51] Int. Cl. [6] ..... H01R 33/955; H01R 4/24

[52] U.S. Cl. ..... 200/51.17; 200/571; 200/284; 439/419

[58] Field of Search ..... 200/51.17, 570, 200/571, 284, 336; 439/417, 419, 426

[56] References Cited

U.S. PATENT DOCUMENTS

| | | | |
|---|---|---|---|
| 2,924,679 | 2/1960 | Brown, Jr. | 200/51.17 |
| 4,283,107 | 8/1981 | Anthony | 200/51.17 |
| 4,839,483 | 6/1989 | Doyle | 200/284 X |

*Primary Examiner*—Renee S. Luebke
*Attorney, Agent, or Firm*—McCormick, Paulding & Huber; John Hilton, Atty.

[57] ABSTRACT

A lamp socket injection molded of thermo plastic in one simple piece for greater safety, plus a switch handle, or actuator. The socket is quickly assembled without tools or stripped bare wires by inserting an insulated electric wire (12) into a close fitting channel (11) in the socket base and then snap-in locking a rotatable switch actuator (9) which drives two puncture pin sets (3 & 8) into both sides of the wire instantly completing the socket circuitry. The switch handle (9), or plug in switchless models, and switch bore (4) also contain a simplified novel on/off design in the form of a springy metal conductive means (10) which transverses the switch handle stem and alternately springs "on" into two conductive means cavities (4-1 & 4-3) and then "off" into two neutral cavities (4-2 & 4-4) which circumscribe the switch bore (4) as the switch is articulated clockwise. This eliminates prior art potential faulty springs, pawls or ratchets. And there are a plurality of strain relief devices to maintain the integrity of the wire connection.

7 Claims, 4 Drawing Sheets

SNAPIN INSTANTLY WIRED ONE PIECE THERMO PLASTIC LAMP SOCKET

CROSS REFERENCE TO RELATED APPLICATION

This application claims priority from the Provisional Application entitled "SnaPin Instantly Wired One Piece Plastic Light Bulb Socket", Ser. No. 013,640 filed Mar. 18th, 1996, by Bates Johnson.

BACKGROUND

1. Field of Invention

This invention relates to electric lamp sockets, also known as portable lamp holders, used in all types of domestic incandescent lamps, wall and ceiling fixtures.

BACKGROUND

2. Description of Prior Art

Socket assemblies are usually divided into switched or non-switched control types. Regardless of type, during the manufacture of household lamps and fixtures all wire terminals thereof are similar to each other. An insulated electric cord must be connected to the socket assembly. In the past, this has been accomplished by the use of screw terminals or by soldering the wires to the terminals.

This traditional method of connecting the wires has always been a slow, costly and hazardous procedure in lamp manufacture. The wire insulation must be split. Each half must be stripped of insulation to expose the wires without cutting the individual wire strands. Each set of strands must be twisted. Then all strands of each wire must be coiled around two screw terminals and screwed down on themselves. A knot should then be tied in the insulated wire. Finally, the two piece "brass shell" must then be aligned and pressed together. The hazards of possible faulty assembly are apparent.

In recognition of these cumbersome, time consuming, costly and hazardous exposed wire assembly procedures, several recent patents have attempted to adress this problem. Each of the following prior patents has, however, tried to solve the problem by merely superimposing or adding onto the 100 year old existing art socket a wire puncturing device.

U.S. Pat. No. 2,728,059 issued to Lagin has two puncturing terminals outside the socket body with a cover to put over them.

U.S. Pat. No. 3,397,379 issued to Puig calls for wires to be separated and threaded through separate bores. There is an added-on sleeve with mating thread to be screwed down on the socket body to press the wire against the terminals.

U.S. Pat. No. 4,529,258 and prior U.S. Pat. No. 4,283,107, both issued to Anthony, divulge a two-piece socket assembly which includes insulation puncturing terminals protruding from the end of the socket's main body. A second cover piece is pivotably mounted on the body and closes over the puncture pins when said cover is screwed down over the wire.

U.S. Pat. Nos. 4,781,616 and 4,874,329 issued to Yu also embody an added-on puncturing device superimposed horizontally across the main body. Each of these patents show an L-shaped recess and a conforming L-shaped coupling member. U.S. Pat. No. 4,781,616 as shown in FIG. 1, has puncturing terminals on the coupling member. And U.S. Pat. No. 4,874,329 has the puncturing terminals in the main body recess and an opening through the corner of the L-shaped coupling member through which the wire is fed. Said coupling member is then forced down over the puncturing terminals causing the wire to be pierced.

While the Yu model has found some acceptance because it eliminates wire stripping and reduces lamp assembly time, it still requires too much time, including these ten wiring steps: (1) The wire must be fed through the socket cap which then dangles on the wire. (2) The socket body must be lifted out of the brass shell in order to raise the L-shaped coupling member. (3) The coupling member must be raised to (4) insert the insulated wire through the corner opening. (5) Holding the insulated wire in place, said L-shaped coupling member is then forced down over the recess to puncture the wires. (6) When fully forced down, the end of said coupling member is then forced against the main body into a locking cavity. (7) The body is then realigned with the brass shell so that the switch slides into the switch slot and the two are rejoined. (8) The wire is then doubled back on itself 180° as a strain relief over said coupling member. (9) Holding the doubled wire tightly, the cap is retrieved and slid up over the doubled wire and (10) finally the cap is aligned and "press here" closed on the brass shell. This sequence is still a costly labor-intensive assembly procedure.

As with other prior art socket puncturing patents, the Yu device only eliminates the need to strip the wires and screw them to the terminals. Instead of taking a fundamentally new approach to socket design, utilizing modern plastics materials and multi-cavity injection molding machinery, it merely superimposes a puncturing device on the old prior art "brass shell" socket. The metal screw shell remains. The cardboard sleeve remains. The insulating discs remain. The rivets remain. The two-piece "brass" shell remains. The toothed cleated washer in the cap remains. The multi-part switching device with grease remains. And the L-shaped coupling is added on. This socket contains 25 component parts. It does not envisage the possibilities of a sturdy, simple and safe instant snap-in wiring procedure and new fool-proof one piece switch mechanism made possible by redesigning the whole socket.

OBJECTS AND ADVANTAGES

As will be seen, the object of this invention is to completely reconfigure the 100 year old state of the art portable lamp socket by making it safer, more durable and nearly assembly-labor free. It's principal novel features are threefold:

First, this new design reduces lamp wiring assembly time from minutes to approximately two seconds. Wiring is accomplished simply by feeding the wire vertically up from the socket base into a bore which opens to receive the puncture pins driven into the wire horizontally by inserting and rim locking the switch handle in place. Slide the wire up and snap in the switch handle and the socket is wired. An integral part of the puncture pins are two hammerheads which drive the wire against sharp ridges in the back of the wire bore and pinch the wire as a double strain relief when the switch handle is fully locked into place.

Second, subject invention goes beyond providing the quickest possible assembly. It departs fundamentally from the prior art two-piece brass shell design with over 20 component parts. It is a one piece injection molded socket, plus switch handle. It takes advantage of the varied and novel properties of modern plastics in terms of heat conductivity, electricity nonconductivity, heat resistence, structural strength, durability, frictionlessness and general viability.

Third, this invention employs a novel one piece more durable switching mechanism. This involves simply inserting a springy metal contact strip laterally through the switch stem with both ends protruding in a counterclockwise direction and springing respectively into two live cavities when the switch is on and two neutral cavities when it is turned off.

These three innovations eliminate the need for the following prior art component parts: A brass shell cap. A metal bulb screw shell. A cardboard bulb insulator. Two composition insulating discs. Two rivets. Two terminal screws. A toothed lock washer in the socket cap. And the miscellaneous springs, cams and a dollop of grease in the various prior art switching mechanisms. From over 20 parts, subject invention reduces a socket to only 7.

Further, these innovations mean a safer, sturdier functional design.

Fewer parts mean less chance of faulty components or improper manufacturing assembly. Eliminating heat degradable components means greater safety. And eliminating the hazardous steps of separating two insulated wire halves, stripping them without severing any of the strands and twisting and cleating under two screw terminals without leaving loose strands removes the chance of end-use assembly short circuits and fires.

Additionally, subject design employs a plurality of at least four strain relief features as means of constraining the insulated wire safely in place once the socket is wired. Finally, as a measure of form following function, the only moving part, once the socket is wired, is the only part which has to move: the switch handle.

DRAWING FIGURES

DESCRIPTION OF THE INVENTION

Figure 1:
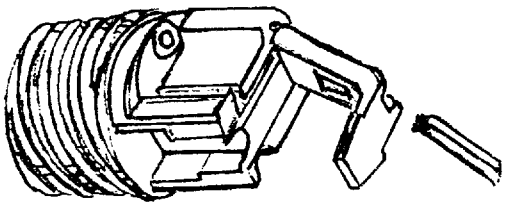
FIG. 1 is a perspective view of the Yu socket assembly.

Referring now to the present invention, and particularly the embodiment in its preferred form as shown in FIGS. 2 through 7, a one piece polymeric socket body 20 is preferably injection molded from a polymeric material of suitable low heat conductivity as well as electrical non-conductivity and sufficient tension, strength and durability for replacing the usual brass shell of the type used in present day assemblies of this type. However, the body 20 does include an upwardly open lamp socket or opening 1 of the type adapted to receive a conventional threaded incandescent lamp base (not shown). A conductive strip 2 is preferably provided in the side wall of this socket opening so that the majority of the socket assembly can be defined by such thermoplastic or polymeric body material.

This conductive strip 2 has a lower portion indicated generally at 3 which defines a neutral contact for the lamp socket, and preferably includes puncture pins as shown at 3-1 and 3-2. This conductive strip 2 is of resilient material so as to be movable from an initial configuration (FIG. 6) to the configuration shown in FIG. 3. The latter view shows the assembly after the insertion of the lamp cord followed by insertion of a switch actuator 9 in a manner to be described. Thus, the puncture pins 3-1 and 3-2 penetrate the insulated lamp cord to provide electrical continuity between one of the lamp cord conductors and the lamp base conductive strip 2.

The bulb opening is further defined by a center contact 5 that is also fabricated from a resilient conductive material as is the case for the strip 2. The top of the contact 5 serves as the live contact for the lamp (not shown) when inserted into the lamp socket. The lower end of this center contact 6 fits into a cavity segment or quadrant 4-1 which is one of a plurality around the bore 4 that receives the shank of a switch actuator 9 to be described. Thus, the lower end portion of the center contact 5 defines a conductive portion 6 that is curved to lay in a cavity quadrant alongside bore 4. A similarly shaped conductive portion 7 of a third conductive element or conductive means resides in an opposite switch handle bore cavity quadrant and is also curved to conform to and fit in an oppositely disposed circumferential cavity from conductive portion 6 as best shown in FIG. 5.

Figure 4:
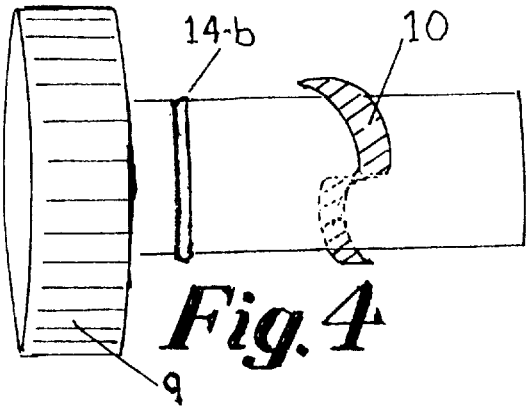
FIG. 4 is a schematic illustration of the switch handle and shaft, and the springy contact strip which traverses the switch shaft.

These conductive means 6 and 7 are selectively connected with one another as the result of an S-shaped or serpentine movable contact 10 that is provided for this purpose in the shank of the switch actuator 9 as shown in FIG. 4.

Figure 2:
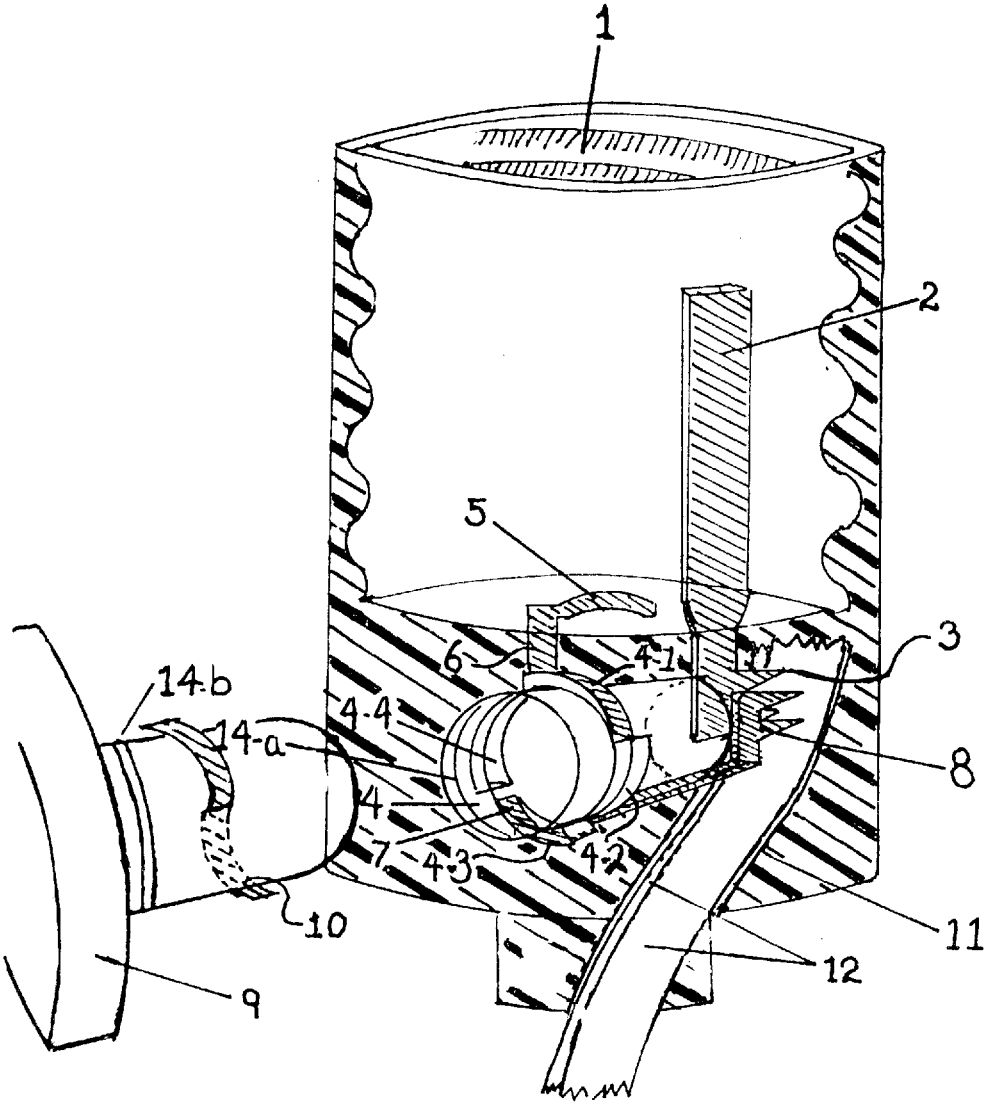
FIG. 2 is an exploded view of the preferred embodiment of this invention and its switch handle.
Figure 3:
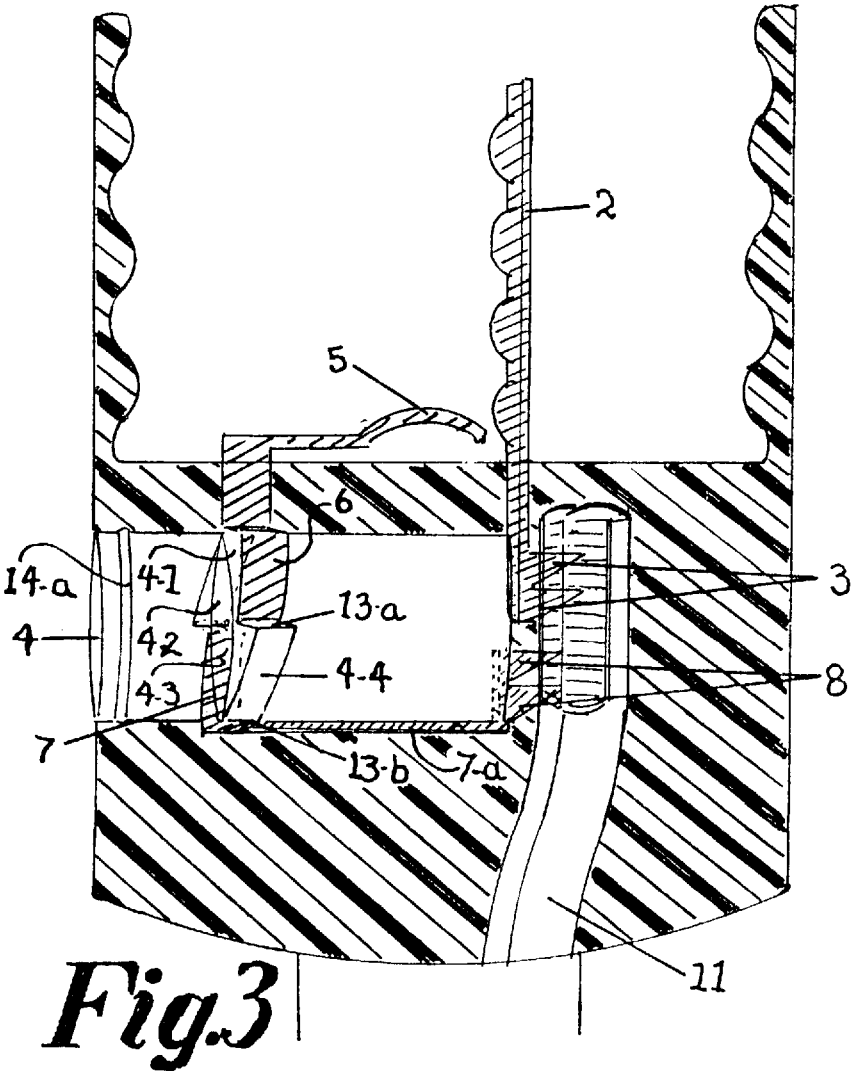
FIG. 3 is schematic drawing of the switch bore showing the circuitry: A contact plate in the bulb opening and two metal puncture pin/hammer heads poised to be driven into and against an insulated wire.
Figure 5:
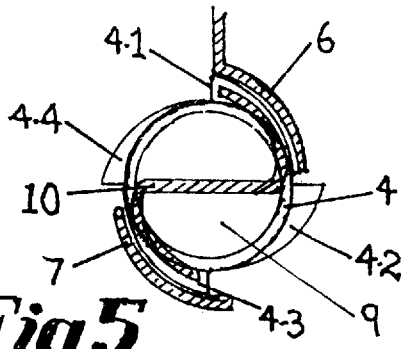
FIG. 5 is a cross section of the switch handle, or actuator, and springy contact strip in the "on" position in the switch bore cavities.
Figure 6:
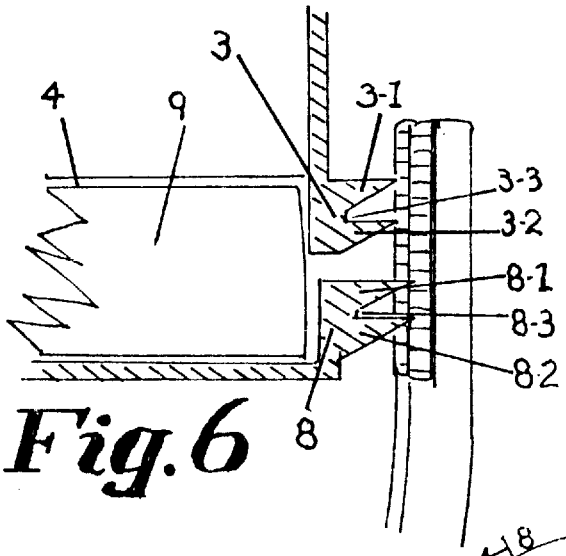
FIGS. 6–9 are detailed views of the several strain reliefs to hold the insulated wire in its channel.
Figure 6A:
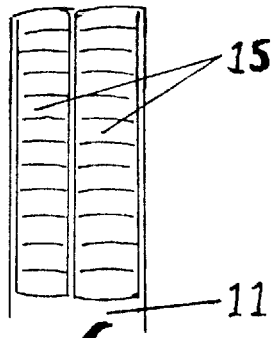

It will be apparent from a comparison of FIGS. 4 and 5 when taken together with the revelation of FIG. 2 that rotation of the actuator knob 9 is effective to turn "on" or "off" the lamp socket assembly just described. However, the switch actuator 9 includes a further function in the environment of the present invention as a result of the fact that insertion of the actuator shank, or plug, into the bore 4 provided for it in the switch body 20 serves to move puncture pins 3 and 8 into the lamp cord. As best shown in FIG. 3, the contact means 7 includes a longitudinally extending portion 7*a* which is oriented along the lower boundary of the switch handle bore 4, and which includes an inner end portion 8 that defines puncture pins 8-1 and 8-2 adapted to be driven into the other conductor or insulated lamp cord in the same manner as the puncture pins 3-1 and 3-2 described previously with reference to the lamp socket fixed outer neutral contact 2. The inner end of the shank of the actuator 9 serves to drive these puncture pins into the lamp cord during the process of assembly of the switch handle actuator 9 with the switch body 20. Preferably, and as shown in the drawings, the portion 7*a* provided in the switch handle shank bore 4 is slidably received in the switch body for this purpose. Therefore, when the switch actuator shank, or plug, is axially inserted into the bore 4, the end portion serves to drive both the lower end 3 of contact element 2 and the inner end portion 8 of the conductive strip 7 axially into the lamp cord as suggested in FIG. 6. FIG. 3 shows the configuration after this assembly step has been accomplished, absent the actuator.

It is a further feature of the invention (as shown in FIG. 5) that the rotary actuator can only be rotated clockwise as a result of the geometry provided in the bore's quadrant cavities arranged around the actuator shank and that the four cavities, paired as opposites 4-1 and 4-3, and 4-2 and 4-4, along with the serpentine contact in the actuator shank, act as paired live "on" and "off" circuit maker and breaker contacts. It will be apparent that the resilient material from which the serpentine contact element 10 is fabricated will result in expansion of the opposed end portions into these various live 4-1 and 4-3 and neutral 4-2 and 4-4 cavities.

A rim lock 14-*a* in the bore 4 serves to lock the switch handle shank in place when the same has been fully inserted in the bore 4 and driven the puncture pins into the wire. The interior end of the bore 4 communicates with the inner end of the lamp cord or wire channel that receives the wire, and the appropriately aligned puncture pins are poised to be driven axially of the bore 4 into the lamp cord during the assembly step described previously. Still with reference to FIG. 3, it will be apparent that the channel 11 which serves to receive the lamp cord 12 has a slightly offset configuration to it and that the upper distal portion of said channel has sharp up-side ridges 15. This geometry and these ridges 15 serve to help anchor the lamp cord in the body 20 of the lamp socket. Other strain relief devices are provided for this purpose also. See for example, the refinements of FIGS. 8 and 9 wherein a lip 16 is provided between the threaded rod base section of the lamp holder body 20 so as to act against the lamp cord particularly when the lamp rod or tube (not shown) is screwed into this threaded portion at the base of the lamp body 20. In addition, or in the alternative, the wire channel 11 is provided with a pair of inwardly facing lips 17 which engage the insulated lamp cord 12 to retain it in position, valve-like, once it has been pushed in place. In any event, such refinements serve to prevent withdrawal of the lamp cord either inadvertently or as a result of misuse once the components have been assembled in the manner described.

Figure 7:
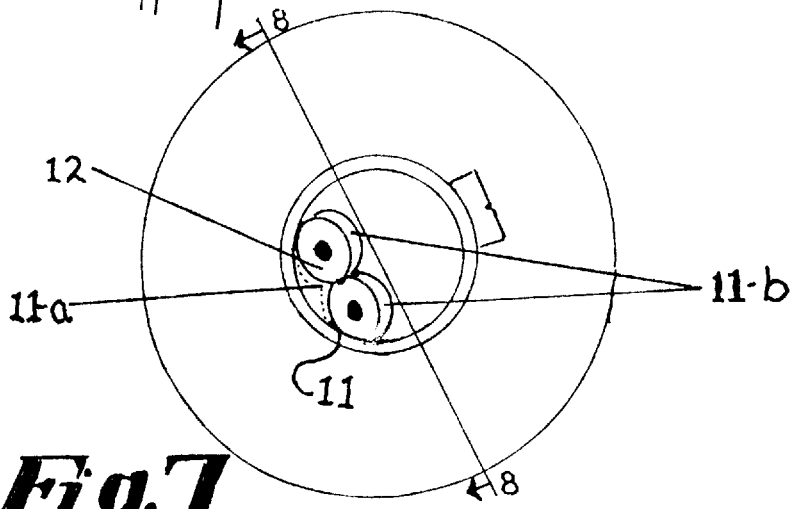

Thus, after the puncture pins indicated generally at 3 and 8 in FIG. 3 have acted on the lamp cord's individual conductive wires, it will be apparent that the lamp cord will be secured in place as a result of these general improvements described with reference to FIGS. 2 through 6 inclusively. FIG. 3 shows the ridges 15 to best advantage. FIG. 7 actually illustrates the improvement of FIG. 9 from a different view. FIG. 7 shows a sectional view taken on the line 7,7 of FIG. 9.

This disclosure is but one version of the invention and other embodiments will be apparent to those skilled in this art. In a non-switched socket, for example, a plug replaces the switch actuator.

OPERATION

The purpose of subject light bulb socket design is to reduce manufacturing and end use assembly labor costs by creating a simple one-piece modern plastic socket which is assembled in two seconds without any tools, thus substantially reducing the lamp manufacturer's, and the public's, assembly labor. The manner of connecting the electricity so as to complete the circuit from power source to light bulb in this invention has been simplified as follows: An electrical insulated wire cord is fully inserted in the contoured-to-fit vertical wire channel 11 in the bottom of the socket. It is not stripped but is inserted as it was produced. The top of said insulated wire will be exposed through an opening in said channel 11 on the side facing the horizontal switch handle bore 4. Said bore 4 is positioned to face the opening in channel 11 and contains the two poised puncture pin/hammer head springy conductive means 3 and 8. When the switch handle 9, or a plug in non-switched models, is fully inserted in said switch bore 4 and rim locked into place, the flat end of said handle 9 simultaneously pushes both springy puncture pin/hammer head conducting means 3 and 8 firmly into and against said insulated wire 12. Two things occur in tandem on each of the two sides of the wire 12: (a) The puncture pins 3-1 and 8-1 effect electrical contact through the wire insulation with the wires therein; and (b) at the same time the hammer head portions of conductive means 3-2 and 8-2, being slightly shorter than said puncture pins, press their flat surfaces firmly against the insulating material on the wires, pinning the wire against the back wall of said wire channel 11. This acts as a strain relief to hold the wire in place. As mentioned in the Description, the top portion of this wire channel 11 back wall contains sharp horizontal up-side ridges, as an additional strain relief, to help hold the insulated wire in place.

This socket wiring design, with its concomitant strain reliefs, uses the insertion motion of said switch handle or actuator 9 not only instantaneously to assemble the socket but said switch handle 9, along with switch bore 4, also contains the novel simple "on-off" switching mechanism. In said switch bore 4 are the sloping cavities, 4-1, 4-2, 4-3 and 4-4, residing sequentially around said switch bore circumference, which are designed to accept the opposing pair of said springy contact plates 10 which run transversely through said switch handle stem 9 and curve laterally around it on either side.

As the switch handle is turned clockwise said pair of springy contact plates 10 in said handle 9 drop off the cliff-like leading edges 13-*a* into the two opposing "live" cavities 4-1 and 4-3 in said switch bore 4 containing conductive means contacts 6 and 7 and thus complete the circuit to turn the lamp on. When said switch actuator 9 is further articulated clockwise said two springy plates 10 rise up a slope in said cavities 4-1 and 4-3 to the switch bore surfaces 13-*b* and then spring off the leading edges of, and into, the neutral cavities 4-2 and 4-4 to turn off the lamp. The cliff-like edges of the four cavities compel the springy conductive contacts 10 to engage and disengage instantly and thus avoid arcing.

The switching mechanism, consequently, which is the only part of a switched socket which must move, is in fact the only part in applicant's socket which does move, accomplishing both the initial snap-in instantaneous assembly and, thereafter, the on-off circuitry. The one-piece switch handle actuator 9 with it's contact plate 10 alone operate the switch and this functional simplicity reduces the chance of faulty parts or hazardous switch malfunctions.

Two more strain reliefs have been incorporated in this device doubly to insure a permanent safe locking of the insulated wire within the socket and to exceed industry standards. First, said third socket opening, wire channel 11 in the socket bottom, has been positioned off-center and up against one edge of the usual threaded cylinder which screws onto the lamp rod. Protruding over the face of said wire channel opening 11 is a plastic flap 16, an integral part of the plastic socket, which slightly intrudes on the space to be occupied by said inserted lamp rod. The act of screwing the lamp rod into position, when assembling a lamp, in the socket base forces said plastic flap 16 down onto said insulated wire, pinning and immobilizing the wire in the channel.

Figure 8:
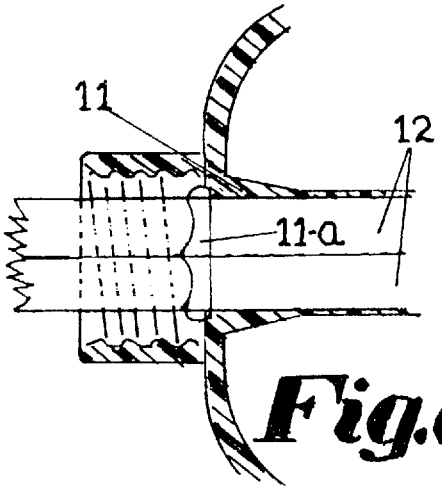
Figure 9:
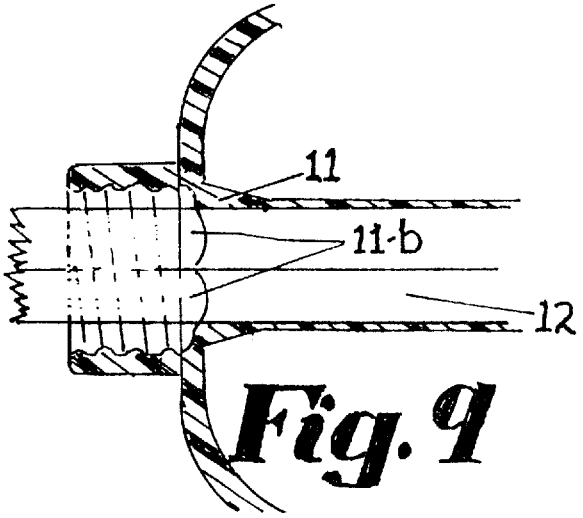

Second, a fourth strain relief is built into the interior side of said channel opening 11, which is shaped like a FIG. 8 to channel the wire in a fixed position. It consists of another integral plastic protrusion in the form of a pair of inner directed plastic lips 17, which just barely part when the insulated wire is inserted therein. Acting like a pair of valves, said lips 17 partially close and clamp against the wire's insulation if and when any attempt is made to pull on or remove the wire.

What is claimed is:

1. An electric lamp socket comprising:

a polymeric plastic body defining a lamp opening, a conductive first contact with a portion defining at least a part of the opening, said body further including a transverse bore oriented transversely of said lamp opening, said body further including a lamp cord channel, said lamp cord channel having an inner end located in close proximity, and open to, an inner end of said transverse bore, said conductive first contact having a second portion defining a puncture pin provided at the inner end of said bore, a second conductive contact having a portion provided centrally of the lamp opening, said second contact having a second portion provided in a first cavity in said transverse bore, a third conductive contact having a portion defining a puncture pin provided in the inner end of said switch bore, said third contact having a second portion provided in a third cavity in said transverse bore opposite said first cavity, and an actuator plug in said bore for engaging said first and third conductive contacts to cause said puncture pin portions to penetrate a lamp cord provided in said channel.

2. The electric lamp socket of claim 1 wherein the first and third conductive contacts with puncture pins have portions of said puncture pins which are hammer heads adapted for restraining a lamp cord in said channel.

3. The electric lamp socket of claim 1 wherein said lamp cord channel contains sharp upside restraining ridges in a posterior upper portion of said channel.

4. The electric lamp socket of claim 1 wherein the interior of said wire channel contains a pair of inward slanting plastic lips adapted to fit around and hold a lamp cord.

5. The electric lamp socket of claim 1 wherein a rim lock is provided for retaining said actuator in said bore.

6. The electric lamp socket of claim 1 wherein said actuator plug comprises a switch actuator, and wherein said switch actuator is rotatably received in said switch bore for rotation through a predetermined angular displacement, and a serpentine conductive contact is provided in said switch actuator so as to selectively engage said second contact and said third contact in said opposing first and third cavities simultaneously and when rotated to selectively disengage said contacts into second and fourth opposing neutral cavities in said bore.

7. The electric lamp socket of claim 6 wherein said actuator plug is rotatable in a clockwise direction only; rotation in the opposite direction being prevented as a result of stop surfaces provided in edges of said four cavities in the bore.

* * * * *